United States Patent [19]

Hunder et al.

[11] Patent Number: 5,011,187

[45] Date of Patent: Apr. 30, 1991

[54] BINDING SYSTEM FOR CONNECTED FAN FOLDED SHEETS

[75] Inventors: Ray A. Hunder; Larry A. Bettenhausen; Alden R. Miles; William A. Mittelstadt; Stephen H. Dwyer; Gary R. Hanson, all of St. Paul, Minn.

[73] Assignee: Minnesota Mining and Manufacturing Company, St. Paul, Minn.

[21] Appl. No.: 294,936

[22] Filed: Jan. 4, 1989

Related U.S. Application Data

[63] Continuation of Ser. No. 144,420, Jan. 14, 1988, abandoned.

[51] Int. Cl.[5] ..... B42D 1/04; B42D 3/02; B42C 11/04; B42C 13/00

[52] U.S. Cl. ..... 281/15.1; 281/21.1; 281/29; 281/36; 412/6; 412/8; 412/19; 412/20; 412/36; 412/901

[58] Field of Search ..... 281/21 R, 21 A, 15 R, 281/21.1, 21.2, 15.1, 27.1, 27.2, 27.3, 29, 36; 412/6, 8, 9, 33, 37, 901, 36, 19, 20

[56] References Cited

U.S. PATENT DOCUMENTS

| | | | |
|---|---|---|---|
| 848,680 | 4/1907 | Nelson | 281/21.1 |
| 1,765,194 | 6/1930 | Von Auw | 281/21.1 |
| 2,455,971 | 12/1948 | Bosch | 281/21.1 X |
| 3,188,114 | 6/1965 | O'Brien et al. | 281/21.1 |
| 3,518,143 | 6/1970 | Fuhr | 156/212 |
| 4,518,296 | 5/1985 | Pearson et al. | 412/37 |
| 4,673,324 | 6/1987 | Hanson et al. | 412/6 |
| 4,762,341 | 8/1988 | Rabuse | 281/29 |

FOREIGN PATENT DOCUMENTS

| | | | |
|---|---|---|---|
| 806258 | 6/1951 | Fed. Rep. of Germany . | |
| 902727 | 1/1954 | Fed. Rep. of Germany . | |
| 1097407 | 1/1961 | Fed. Rep. of Germany . | |
| 1126667 | 11/1956 | France . | |
| 1044481 | 9/1966 | United Kingdom | 281/21 R |

*Primary Examiner*—Paul A. Bell

*Attorney, Agent, or Firm*—Gary L. Griswold; Walter N. Kirn; William L. Huebsch

[57] ABSTRACT

A binding system including a method for binding connected fan folded sheets in which a stack of the sheets is shingled to disclose narrow side surface portions along their spine edges, a layer of pressure sensitive adhesive on a highly flexible backing is adhered to those spine edges and narrow side surface portion after which the spine edges are moved into alignment at a right angle to the side surfaces of the sheets to cause the backing and layer of pressure sensitive adhesive to pleat around the spines of the sheets. The system also includes a novel cover structure which facilitates the method and includes cover plates, the pressure sensitive adhesive and the backing; and a novel device for holding and positioning the sheets during binding.

17 Claims, 8 Drawing Sheets

BINDING SYSTEM FOR CONNECTED FAN FOLDED SHEETS

This is a continuation of application Ser. No. 144,420 filed Jan. 14, 1988 now abandoned.

TECHNICAL FIELD

The present invention relates to systems using pressure sensitive adhesive for binding a stack of generally uniformly sized connected sheets of the type sometimes called continuous forms, folded or fan folded sheets (called connected fan folded sheets herein), each of which sheets in the stack has a spine edge opposite an outer edge and, except for the outermost sheets which are each joined along only one edge, is joined at its edges (typically along lines of perforations) to sheets adjacent its major surfaces in the stack with the spine edge of the sheet joined to the spine edge of the sheet along one of its side surfaces and the outer edge of the sheet joined to the outer edge of the sheet along the other of its side surfaces; which systems include cover structures, methods, and devices used in binding such connected fan folded sheets and the bound documents produced thereby.

BACKGROUND ART

The art describes systems for binding stacks of such connected fan folded sheets using adhesive, which systems include cover structures, methods, and/or devices used in binding such sheets and produce various types of bound documents. U.S. Pat. No. 3,188,114 describes such a system in which a layer of pressure sensitive adhesive already adhered to a backing is adhered over the spine edges so that the backing and layer of pressure sensitive adhesive bind the stack into a document.

While such systems may produce a useful bound document that can be formed by persons with no particular binding skill in an office or in a home without the need for passing mechanical binding devices through openings in the sheets that can obstruct information on the sheets and restrict easy opening of the document, known systems of this type have required a more complex cover structure than may be desired.

DISCLOSURE OF THE INVENTION

The present invention provides an effective system including simple binding and cover structures for binding stacks of connected fan folded sheets (particularly thick stacks up to more than 6 inches thick) using pressure sensitive adhesive, which system persons in an office or a home with no particular binding skill can use to form bound documents from such a stack, and which bound documents formed by the system are securely bound and can lay completely open with all portions of the sheets to which the document is opened parallel to afford easy reading of information on the sheets from edge to edge.

The system according to the present invention includes a method for binding a stack of generally uniformly sized connected fan folded sheets comprising the steps of (1) disposing the stack of sheets with narrow side surface portions of the sheets adjacent their spine edges exposed beyond the spine edges of overlying sheets; (2) pressing a generally planar uniformly thick layer of pressure sensitive adhesive already adhered to a generally planar portion of a highly flexible backing with low resiliency over the spine edges and exposed narrow side surface portions; and (3) moving the sheets to a position with the spine edges of the sheets generally aligned in a plane generally at a right angle to the side surfaces of sheets in the stack to pleat the layer of pressure sensitive adhesive and backing by retained adhesion of the layer of pressure sensitive adhesive with the spine edges and the narrow side surface portions of the sheets contacted by the layer of pressure sensitive adhesive in said pressing step, and to cause adhesion of the layer of pressure sensitive adhesive to narrow side surface portions of the sheets adjacent the narrow side surface portions of the sheets contacted by the layer of pressure sensitive adhesive in said pressing step.

Preferably during the disposing step the sheets are disposed so that the narrow side surface portions have a width in a direction at a right angle to the spine edges at least three (3) times the thickness of each individual sheet in the stack, or one and one half (1 ½) times the total thickness of each adjacent pair of sheets joined along their spine edges, only one of which pair of sheets will be contacted by the pressure sensitive adhesive during the pressing step, and the other of which pair of sheets will be contacted by the pressure sensitive adhesive during the moving step. For commonly used 0.010 centimeter (0.004 inch) thick fan folded paper, the preferred width of the narrow side surface portions would thus be at least 0.030 centimeter (0.012 inch).

The method can include adhering the pressure sensitive adhesive on end portions of the backing to portions of the end sheets in the stack along their spine edges. Alternatively, the method can be performed using a novel first cover assembly including a first cover plate adapted to be placed adjacent one side surface of the stack to which one end portion of the highly flexible backing is adhered, and a second cover plate adapted to be placed adjacent the opposite side surface of the stack. The cover plates are positioned on opposite side surfaces of the stack with spine edges of the cover plates aligned with the spine edges of the sheets during the disposing step; and an edge portion of the flexible backing opposite the first cover plate is adhered to a portion of the second cover plate adjacent its spine edge during the applying step. Additionally the cover assembly can include a first release liner adhered over a major portion of the layer of pressure sensitive adhesive adjacent the first cover plate, and a second release liner adhered over a minor portion of the layer of pressure sensitive adhesive at the end of the backing opposite the first cover plate; and the method can further include removing the first liner from the layer of pressure sensitive adhesive while leaving the second liner in place prior to the pressing step; pulling on the end portion of the backing opposite the first cover plate by grasping it and the opposite second liner during the pressing step to smoothly distribute the backing and layer of pressure sensitive adhesive over the spine edges and narrow side surface portions during the pressing step; and removing the second liner from the layer of pressure sensitive adhesive prior to the adhering step.

Both the backing and layer of pressure sensitive adhesive must be sufficiently flexible and low in resilience to pleat while remaining adhered together and retaining adhesion of the layer of pressure sensitive adhesive to the spine edges and adjacent narrow edge portions of the sheets during such application to bind them.

A preferred nonwoven fabric with the desired flexibility and low resiliency when the pleats are formed extending in one direction along the fabric is a 35 grams per square meter (1 ounce per square yard) spun bonded polyamide nonwoven fabric commercially available as Lutrabond #3135 from Lutravil Co., Durham, N.C. The flexibility/stiffness of such a nonwoven fabric when bent in an arc extending in one direction along the fabric can be measured by the INDA (International Nonwoven Disposable Assoc.) Standard Test, "Handle-O-Meter Stiffness" IST 90.0-75 R-82 (a copy of which test is available from INDA, Association of the Nonwoven Fabrics Industry, 1700 Broadway, New York, N.Y. 10019, the content whereof is incorporated herein by reference). That test generally requires having a blade centered over a slot press the test piece of material (which is initially laid across the slot) into the slot while measuring and recording the maximum resistance force the blade encounters in flexing or bending the fabric in an arc extending in one direction along the test piece of material to push it into the slot which force is a measure of both flexibility and surface friction of the nonwoven. The flexibility/stiffness of the Lutrabond #3135 fabric measured by testing a 20.32 centimeter by 20.32 centimeter (8 inches by 8 inches) test sample of the fabric and pressing it into the slot when the slot is adjusted to be 0.635 centimeter (¼ inch) wide is about 60 to 95 grams resistance to flexing when the "cross direction flexibility" of the fabric sample is tested by the blade causing the test sample of that fabric to bend in an arc extending in a first direction along the material that is the machine direction with regard to the way the material is made; and is about 100 to 140 grams resistance to flexing when the "machine direction flexibility" of the fabric sample is tested by the blade causing the test sample of that fabric to bend in an arc extending in a direction at a right angle to the first direction which is the cross machine direction with regard to the way the material is made. Such fabric is suitable for use as the backing for the present invention when the machine direction of the fabric is aligned with the spine edges of the sheets so that the arcs around which the material will have to bend to form pleats in the binding system described above will be easily formed.

Other sheet materials that, while not preferred, can be used as the backing in the present invention with satisfactory results include the 35 grams per square centimeter (1 ounce per square yard) 50/50 polyester/-cellulose nonwoven fabric available under the trade designation "Confil No. 1310220" from International Paper Company, Lewisburg, Pa., which has a "cross direction flexibility" in the range of 85 to 110 grams when tested by the INDA "Handle-O-Meter Stiffness" Test; the 35 grams per square centimeter (1 ounce per square yard) polypropylene nonwoven fabric available under the trade designation "Celestra" from James River Corporation, Washougal, Wash., which has a "cross direction flexibility" in the range of 50 to 55 grams when tested by the INDA "Handle-O-Meter Stiffness" Test; the 0.0025 centimeter (0.001 inch) thick ethylene vinyl acetate film available from Consolidated Thermoplastics, Chippewa Falls, Wis., which has a "cross direction flexibility" in the range of 12 to 15 when tested by the INDA "Handle-O-Meter Stiffness" Test; the 0.005 centimeter (0.002 inch) thick 50/50 polyethylene/polypropylene cast film available under the trade designation "RX270" from Consolidated Thermoplastics, Chippewa Falls, Wis., which has a "cross direction flexibility" in the range of 105 to 125 grams when tested by the INDA "Handle-O-Meter Stiffness" Test; and the 0.003 centimeter (0.0012 inch) thick polyethylene film available under the trade designation "TRX1630 from Consolidated Thermoplastics, Chippewa Falls, Wis., which has a "cross direction flexibility" in the range of 22 to 26 when tested by the INDA "Handle-O-Meter Stiffness" Test.

The maximum flexibility/stiffness of materials determined by the INDA "Handle-O-Meter Stiffness" Test using the test sample size and slot width indicated above that would give acceptable results as the backing in the present invention would appear to be about 200 grams resistance to flexing when the blade causes the test sample of that material to bend in an arc extending in the same direction along the material as the arcs around which the material will have to bend to form pleats in the binding system described above.

Pressure sensitive adhesives that are suitable as the layer of pressure sensitive adhesive in the binding system described above should have a minimum adhesion of 30 ounces per inch, and preferably more than 50 ounces per inch when tested in accordance with ASTM D 3330-81 entitled "Peel Adhesion of Pressure-sensitive Tape at 180 degree Angle" (a copy of which can be obtained from the American Society for Testing and Materials, 1916 Race Street, Philadelphia, Pa. 19103, the content whereof is incorporate herein by reference) by adhering a piece of white bond paper (i.e., the white copy machine paper available under the trade designation "Type 696" by 3M Company, St. Paul, Minn.) to a glass plate with double coated tape, adhering a ½ inch wide strip comprising the pressure sensitive adhesive to be tested on a backing to the surface of the paper opposite the glass plate, and peeling one end of the strip from the paper by bending the strip 180 degrees and pulling it parallel to the surface of the paper so that the adhesive is pealed from the paper at a speed of 12 inches per minute.

The adhesive should also resist dead load peel for at least 500 minutes, and preferably more than 2000 minutes when tested as illustrated in FIG. 16 by adhering a piece 2 of the same white bond paper to a stainless steel plate plate 3 with double coated tape 4, adhering a ½ inch wide strip 5 comprising a layer 6 of the pressure sensitive adhesive to be tested on a backing 7 to the surface of the piece 2 of paper opposite the stainless steel plate along a ¾ inch length 8 at one end of the strip 5, positioning the plate 3 vertically, bending the strip 5 180 degrees away from the plate 3, and hanging a 100 gram weight 9 from the end of the strip 5 opposite its adhered end length 7 so that the weight 9 tends to peel the strip 5 from the piece 2 of paper.

Additionally, the adhesive should achieve a value of at least 15 ounces per inch, and preferably greater than 20 ounces per inch when tested by the test identified as Quick Stick PSTL-5, which is Test number 5 of Pressure Sensitive Tape Council, a copy of which can be obtained from PSTC Council, 1201 Waukegan Road, Glenview, Ill., 60025, the content whereof is incorporated herein by reference.

Pressure sensitive adhesives that are suitable as the layer of pressure sensitive adhesive in the binding system described above include a tackified, crosslinked acrylic adhesive described in U.S. Pat. No. 4,418,120 (incorporated herein by reference), which is a copolymer in a 94:6 ratio of isooctlacrylate to acrylic acid, containing a tackifying rosin ester and an antioxidant; and tackified block copolymers typified by tackified block copolymers containing styrene and diene components, and tackified by polymerized pinene resin, and stability with antioxidants and U.V. light inhibitors.

The system according to the present invention further includes a device which facilitates practicing the method described above for binding a stack of connected fan folded sheets. The device preferably comprises positioning means on a frame for positioning the stack of sheets surface to surface in a straight position with their spine edges and their outer edges aligned in generally horizontal planes at right angles to their side surfaces and their side surfaces extending generally vertically upwardly from their outer edges, which positioning means includes a locating wall having a generally horizontal alignment surface adapted to support the outer edges of the sheets. Also included in the device is arching means activatable with the stack of sheets initially in the first position for arching a portion of the stack of sheets between their spine and outer edges about an axis parallel to their edges while retaining their outer edges in a plane at a right angle to adjacent portions of the side surfaces to cause relative slippage of portions of the sheets adjacent their spine edges and expose narrow side surface portions of the sheets adjacent their spine edges on corresponding side surfaces of the sheets so that a layer of pressure sensitive adhesive may be applied thereto, and for subsequently affording manual return of the arched stack of sheets to the first position to again cause relative slippage of portions of the sheets adjacent their spine edges to again align their spine edges in a plane generally at a right angle to the side surfaces of the sheets. The arching means comprises clamping means mounted on the frame adjacent the locating wall and including fixed and movable opposed jaws for firmly clamping the aligned stack of sheets together adjacent their outer edges, the fixed jaw being fixed to the frame, and the clamping means including means mounting the movable jaw for movement relative to the fixed jaw between clamped and released positions relative to the stack of sheets between the jaws; means for defining an arcuate surface on the frame at one side of the positioning means to support and shape one side of the stack of sheets into an arc when the end portion of the stack of sheets adjacent their spine edges is moved into engagement with the arcuate surface; a pressing bar having opposite ends and an elongate pressure surface between the ends; means for mounting the pressing bar on the frame for movement between a retracted position spaced along the side of the stack in its straight position opposite the arcuate surface, and a pressing position more closely adjacent the pressure surface so that the bar presses the stack from the straight position to a position with one side surface of the stack in contact with the arcuate surface so that a portion of the stack is arced; and manually operable means for sequentially moving the movable jaw of the clamp from its released position to its clamped portion and the pressing bar from its retracted position to its pressing position, and then sequentially returning the pressing bar from its pressing position to its retracted position and the movable jaw from its clamped position to its released position.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
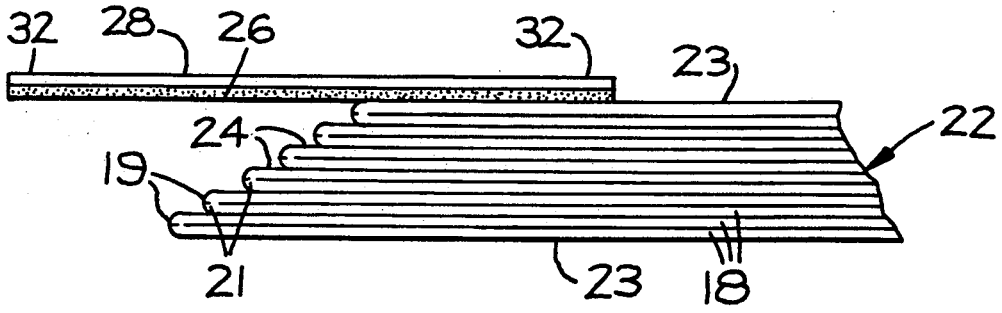
FIGS. 1 through 3 are enlarged fragmentary edge views sequentially illustrating a method for binding connected fan folded sheets to form a bound document, which method and document are both included in the system according to the present invention.
Figure 2:
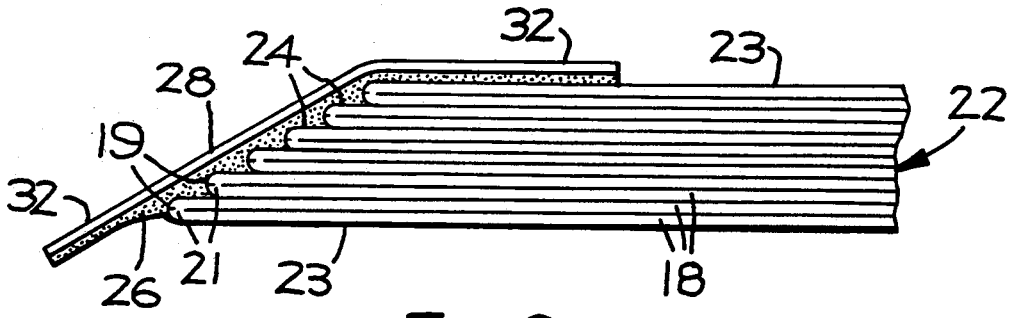
Figure 3:
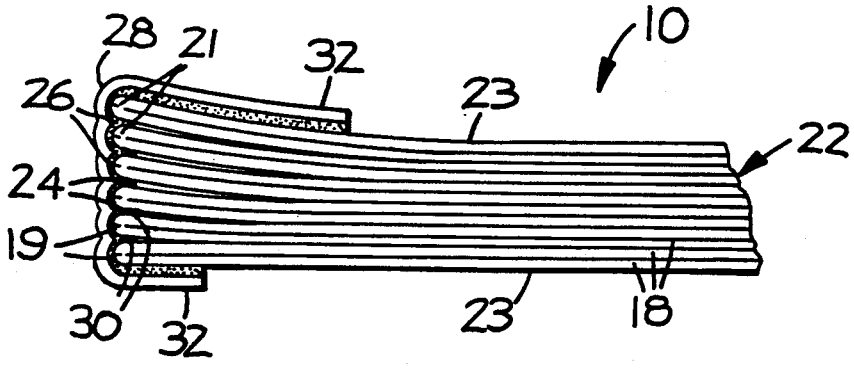
Figure 4:
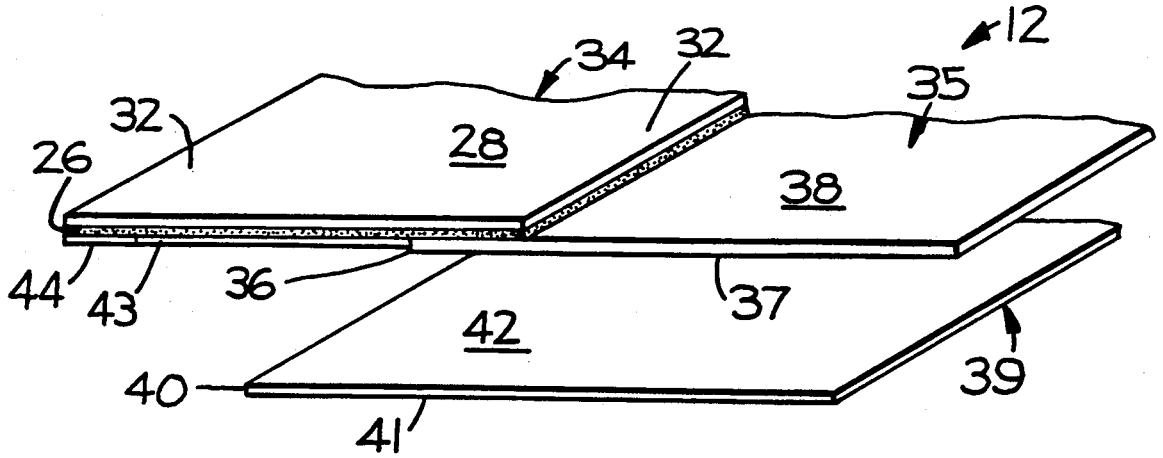
FIG. 4 is a fragmentary perspective view of a novel cover structure included in the system according to the present invention that can be used for binding connected fan folded sheets.
Figure 9:
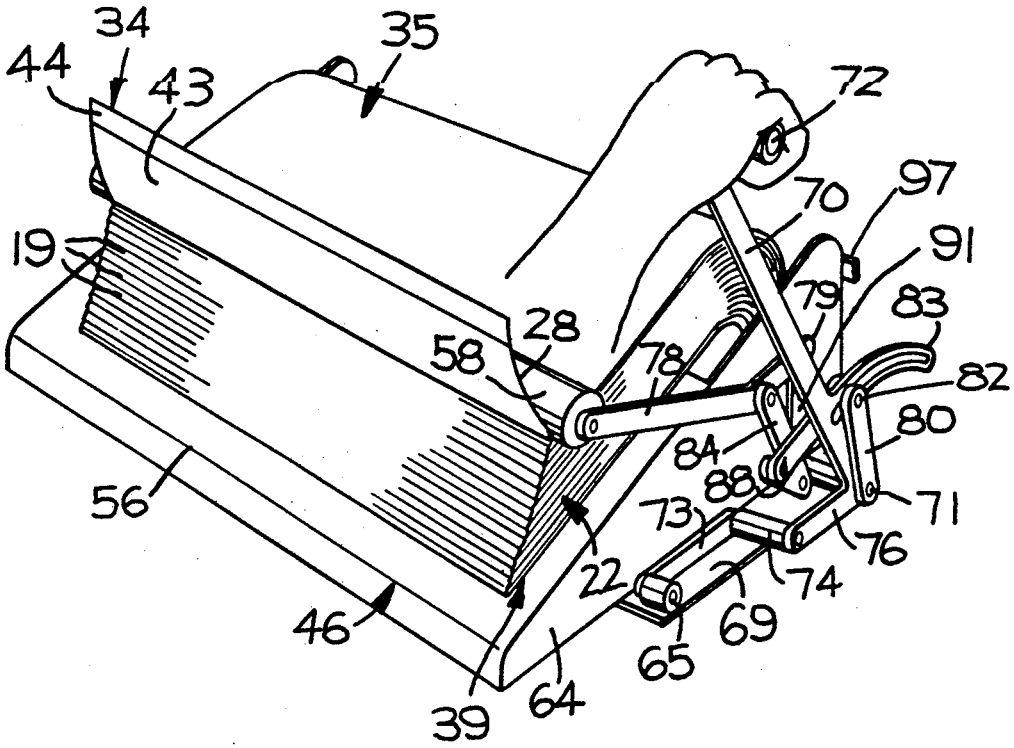
Figure 12:
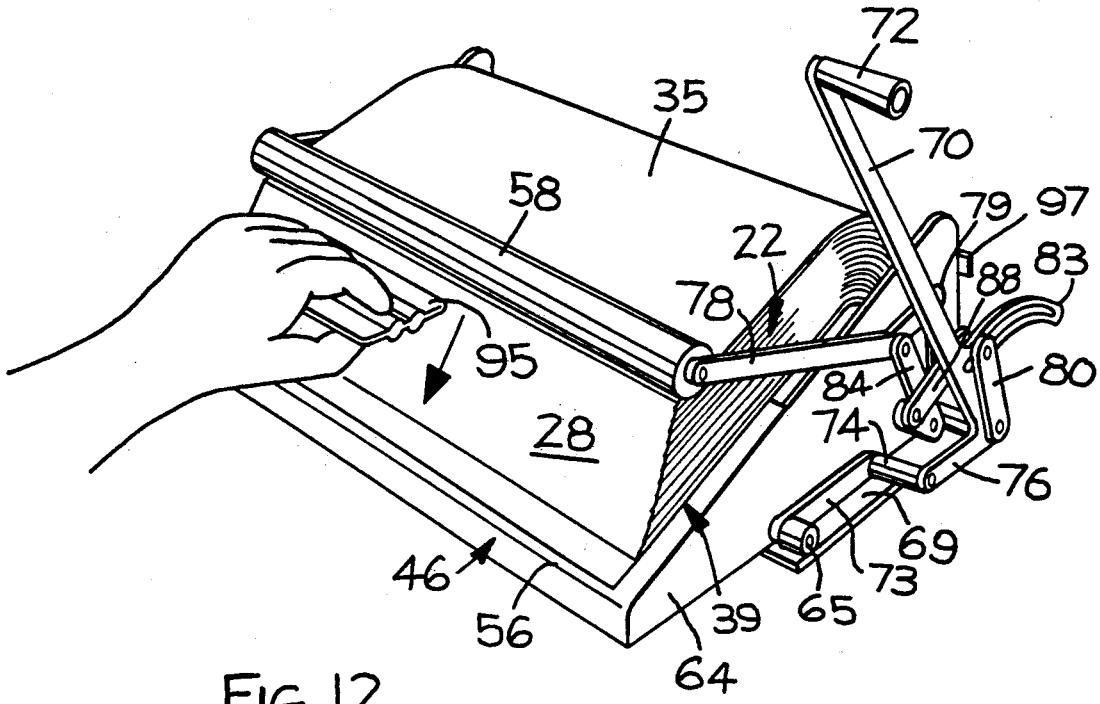
Figure 13:
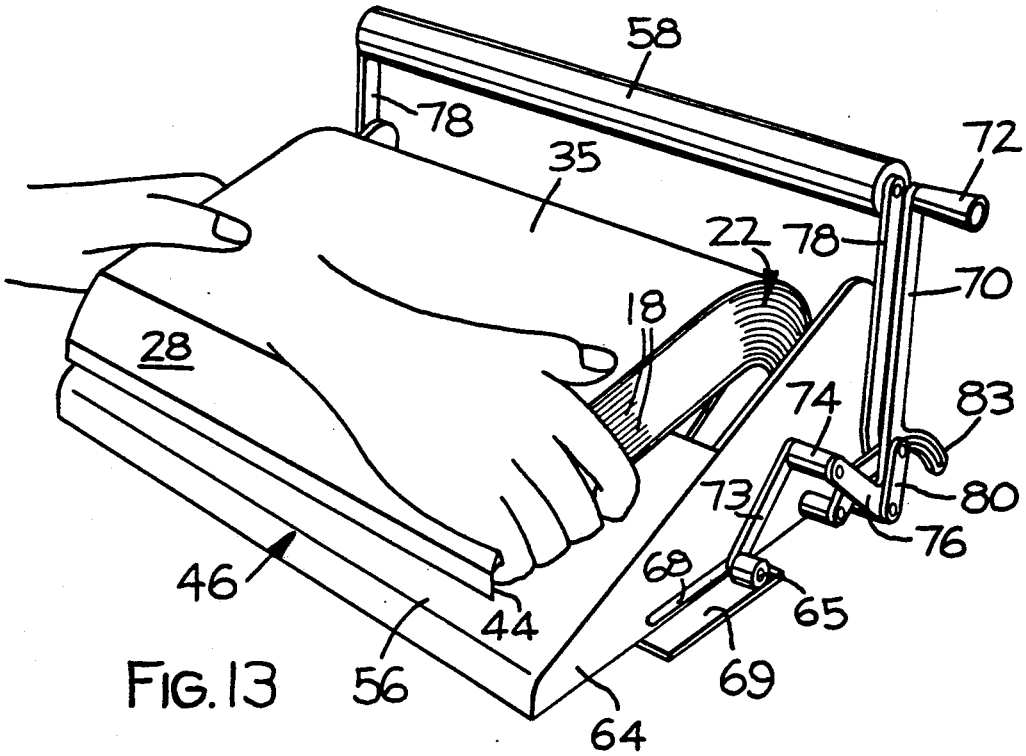
Figure 15:
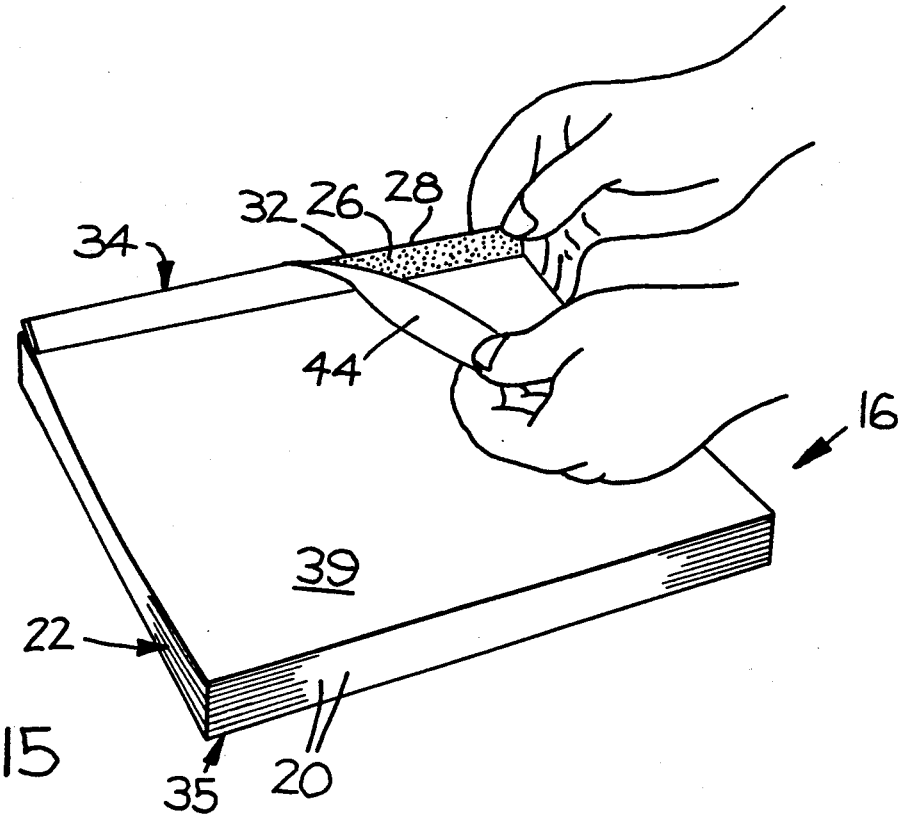
Figure 14:
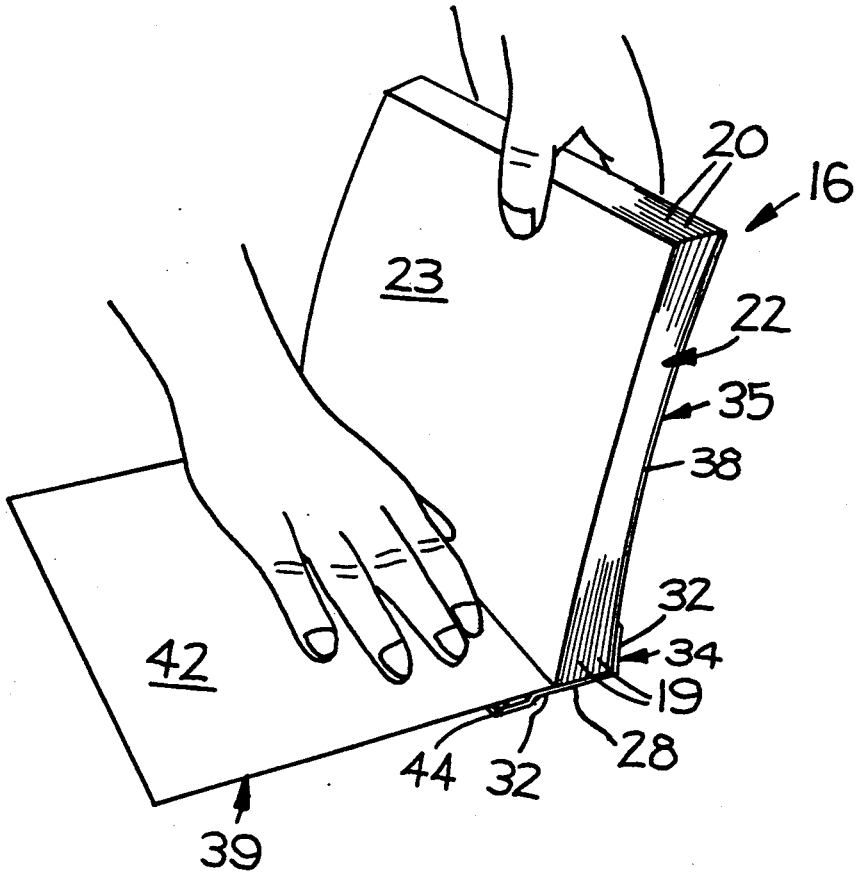
Figure 16:
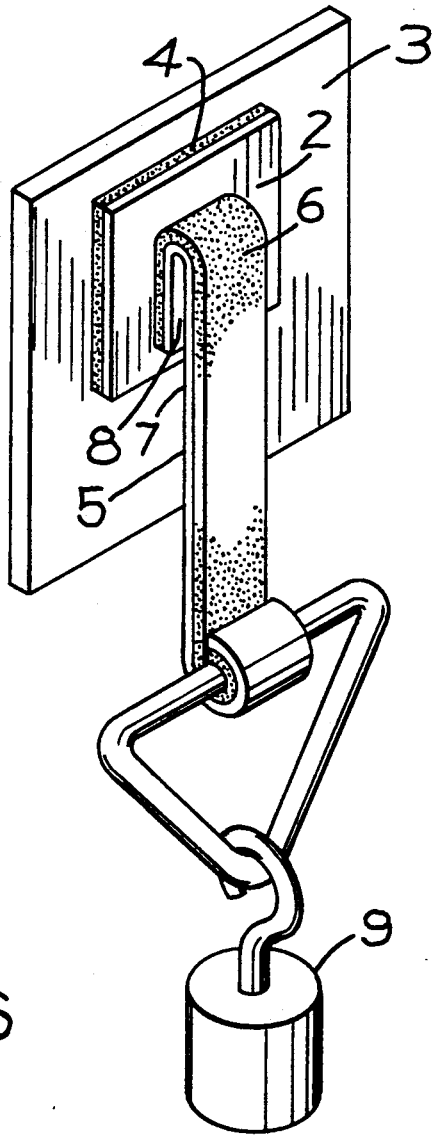
FIG. 16 is a perspective view of a test performed on adhesives used in the system according to the present invention.

Referring now to the drawing, there is shown a system according to the present invention for binding connected fan folded sheets using a method sequentially illustrated in FIGS. 1 through 3 to form a bound document 10, which system may additionally include a cover structure 12 shown in FIG. 4 and/or a device 14 illustrated in FIGS. 5 through 13 that can be used to form the bound document 10 illustrated in FIG. 3 using the method illustrated in FIGS. 1 through 3 or a bound document 16 illustrated in FIGS. 14 and 15 using the method illustrated in FIGS. 6 through 15.

Generally the method according to the present invention sequentially illustrated in FIGS. 1, 2 and 3 is for binding a stack 22 of connected fan folded sheets 18 to form the bound document 10, each of which sheets 18 in the stack 22 has a spine edge 19, an outer edge 20 (not shown FIGS. 1–3) opposite the spine edge 19, and opposite major side surfaces, and each of which sheets 18 in the stack 22, except for the outermost sheets 18 which are each joined only along one edge 19 or 20, is joined at both of its edges 19 and 20 along a line of perforations 21 to sheets 18 adjacent its major surfaces with the spine edge 19 of the sheet 18 being joined to the spine edge 19 of the sheet 18 along one of its side surfaces, and the outer edge 20 of the sheet 18 being joined to the outer edge 20 of the sheet 18 along the other of its side surfaces.

The method comprises the steps of (1) disposing the sheets 18 in the stack 22 so that narrow side surface portions 24 of the sheets 18 adjacent their spine edges 19 are exposed beyond the spine edges 19 of overlying sheets 18 (FIG. 1); (2) pressing a generally planar uniformly thick layer 26 of pressure sensitive adhesive already adhered to a generally planar highly flexible backing 28 over the spine edges 19 and exposed narrow side surface portions 24 (FIG. 2); and (3) moving the sheets 18 to a position with the spine edges 19 of the sheets 18 generally aligned in a plane at a right angle to the side surfaces of sheets 18 in the stack 22 as shown in FIG. 3 to pleat the layer 26 of pressure sensitive adhesive and the backing 28 by retained adhesion of the layer 26 of pressure sensitive adhesive with the spine edges 19 and the narrow side surface portions 24 of the sheets 18 contacted by the layer 26 of pressure sensitive adhesive in said pressing step, and cause adhesion of the layer 26 of pressure sensitive adhesive to narrow side surface portions 30 of the sheets 18 adjacent the narrow side surface portions 24 of the sheets 18 contacted by the layer 26 of pressure sensitive adhesive in the pressing step. End portions 32 of the flexible backing 28 can be adhered by the layer 26 of pressure sensitive adhesive to the end sheets 18 defining side surfaces 23 of the stack 22 as is illustrated in FIGS. 1, 2, and 3, or to cover plates positioned at the side surfaces 23 of the stack 22 which are not illustrated in FIGS. 1, 2 or 3, but which are provided when the cover structure 12 shown in FIG. 4 and described below is used to perform the method.

Use of the method described above to bind a document is facilitated by using the cover structure 12 illustrated in FIG. 4 which comprises a first cover assembly 34 including a first cover plate 35 of a stiff flexible material (e.g., 0.038 centimeter (0.015 inch) thick coated and embossed cover stock available under the trade designation "Norval" cover stock from Boise Cascade, Brattoboro, Vt.) having a spine edge 36, an inner surface 37 adapted to be placed adjacent one side surface 23 of the stack 22, and an outer surface 38 to a portion of which one end portion 32 of the highly flexible backing 28 is adhered by the layer 26 of pressure sensitive adhesive. The first cover plate 35 has about the same major surface dimensions as the sheets 18 to be bound, but is preferably about 0.0127 centimeter (0.005 inch) shorter between its spine edge 36 and opposite outer edge than sheets 18 in the stack 22 to insure that the layer 26 of pressure sensitive adhesive will contact the narrow side surface portion 24 and spine edge 19 of the sheet 18 adjacent the first cover plate 35 when the cover structure 12 is applied to a stack 22 in the manner described hereinafter. The cover structure 12 also includes a second cover plate 39 of the same stiff flexible material having about the same major surface dimensions as the sheets 18 to be bound, having a spine edge 40, an outer surface 41, and an inner surface 42 adapted to be placed adjacent the opposite side surface 23 of the stack 22. In addition to the method step described above, use of the cover structure 12 further includes positioning the cover plates 35 and 39 on the opposite side surfaces 23 of the stack 22 with the spine edges 36 and 40 of the cover plates 35 and 39 aligned with the spine edges 19 of the sheets 18 during the disposing step; and adhering the end portion 32 of the backing 28 opposite the first cover plate 35 to a portion of the outer surface 41 of the second cover plate 39 adjacent its spine edge 40 during the applying step as will be described more fully hereinafter. Additionally, the cover structure 12 includes a first release liner 43 releasably adhered over a major portion of the layer 26 of pressure sensitive adhesive adjacent the first cover plate 35, and a second release liner 44 releasably adhered over a minor portion of the layer 26 of pressure sensitive adhesive adjacent the end of the backing 28 opposite the first cover plate 35 so that the method further includes removing the first release liner 43 from the layer 26 of pressure sensitive adhesive while leaving the second release liner 44 in place prior to the pressing step; pulling on the backing 28 by grasping it and the second release liner 44 during the pressing step to smoothly distribute the backing 28 and layer 26 of pressure sensitive adhesive over the spine edges 19 and narrow side surface portions 24 of the sheets 18 during the pressing step; and removing the second release liner 44 from the layer 26 of pressure sensitive adhesive prior to the adhering step as will also be described in further detail hereinafter in conjunction with use of the device 14 to bind the document 16 illustrated in FIGS. 14 and 15.

Figure 5:
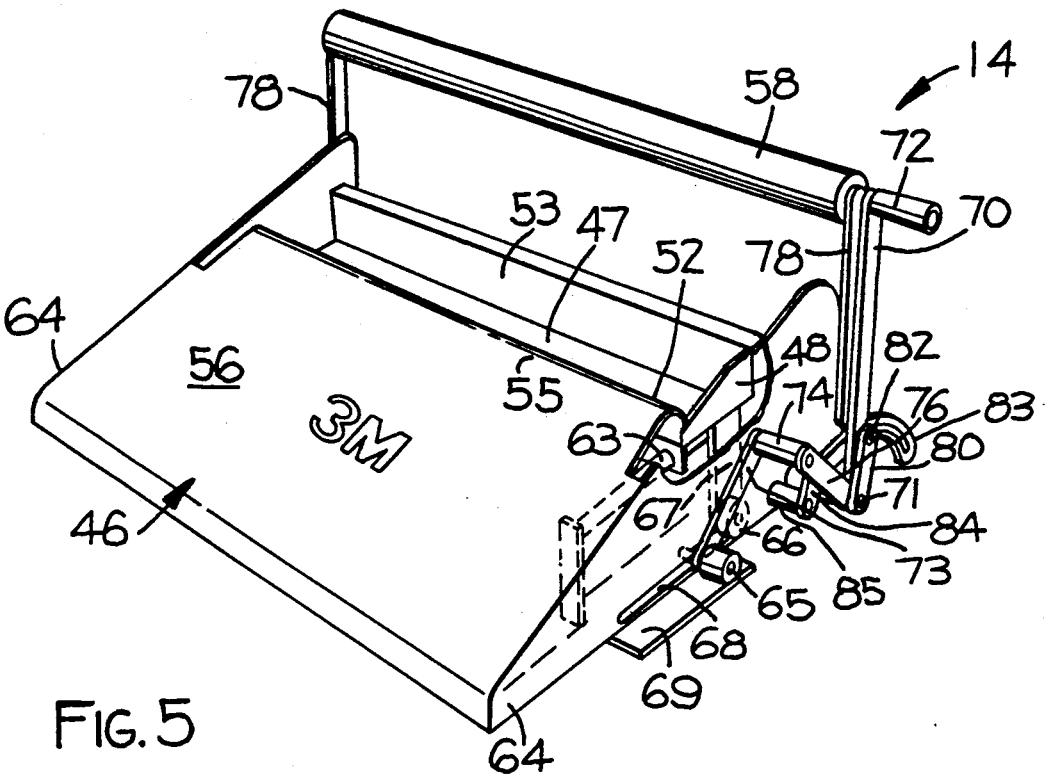
FIG. 5 is a perspective view having parts broken away to show detail of a device included in the system according to the present invention that can be used for binding connected fan folded sheets using the cover structure of FIG. 4 and a method similar to that shown in FIGS. 1 through 3.

FIG. 5 illustrates the device 14, and FIGS. 5 through 13 sequentially illustrate using the device 14 to bind connected fan fold sheets 18 into the bound document 16 using the cover structure 12 and the method for using it described above.

Generally, as is best seen in FIG. 5, the device 14 comprises positioning means on a frame 46 of the device 14 for positioning the sheets 18 face to face in the aligned stack 22 in a straight position (shown in FIGS. 6, 7 and 8) with their spine edges 19 and their outer edges 20 aligned in generally horizontal planes at right angles to their side surfaces and the side surfaces of the sheets 18 extending generally vertically upwardly from their outer edges 20, which positioning means includes a horizontal locating wall having a generally horizontal alignment surface 47 adapted to support the outer edges 20 of the sheets 18, and a vertical locating wall 48 having a vertical inner surface against which edges of the sheets 18 in the stack 22 may be aligned. Also included in the device 14 is arching means manually operable with the stack 22 of sheets 18 initially in the straight position for pressing a portion of the stack 22 of sheets 18 between their spine and outer edges 19 and 20 (as shown in FIGS. 9–12) about an axis parallel to those edges 19 and 20 to an arched position of the sheets 18 while retaining the outer edges 20 of the sheets 18 in a plane at a right angle to adjacent portions of their side surfaces to cause relative slippage of portions of the sheets 18 adjacent their spine edges 19 and expose narrow side surface portions 24 of the sheets 18 adjacent their spine edges 19 on corresponding side surfaces of the sheets 18 so that the layer 26 of pressure sensitive adhesive may be applied thereto, and for subsequently affording manual return of the arched stack 22 of sheets 18 to the straight position to again cause relative slippage of portions of the sheets 18 adjacent their spine edges 19 to again align their spine edges 19 in a plane generally at a right angle to the straightened side surfaces of the sheets 18. The arching means comprises clamping means mounted on the frame 46 adjacent the horizontal alignment surface 47 that includes fixed and movable opposed jaws 52 and 53 for firmly clamping the aligned stack 22 of sheets 18 together adjacent their outer edges 20, the fixed jaw 52 being fixed to the frame 46, and the clamping means including means mounting the movable jaw 53 on the frame 46 for movement relative to the fixed jaw 52 between clamped and released positions relative to a stack 22 of sheets 18 between the jaws 52 and 53; shaping means including a top wall of the frame 46 having an arcuate surface portion 55 with a radius of about 1.9 centimeter (0.75 inch) tangent on one side with the stack engaging surface of the fixed jaw 52 and at the other with a planar surface portion 56 of the top wall extending downwardly away from the arcuate surface portion 55 at an angle of about 115 degrees with respect to the vertical contact surface of the fixed jaw 52, which arcuate and planar surface portions 55 and 56 shape one portion of the side surface 23 of the stack 22 in an arc when the end portion of the stack 22 adjacent the spine edges 19 of the sheets 18 in the stack 22 is moved into engagement with the arcuate and planar surface portions 55 and 56; a pressing bar 58 having an elongate pressure surface between opposite ends; means for mounting the pressing bar 58 on the frame 46 for movement between a retracted position spaced from the side surface 23 of the stack 22 in its straight position that is opposite the arcuate surface portion 55 and adjacent the spine edges 19 of the sheets 18 in the stack 22, and a pressing position more closely adjacent the planar surface portion 56 so that the bar 58 can move the stack 22 from the straight position to the arched position with one side surface 23 of the stack 22 in contact with the arcuate and planar surface portions 55 and 56 so that a portion of the stack 22 is shaped in an arc; and manually operable actuating means 61 for sequentially moving the movable jaw 53 of the clamping means from its released position to its clamped position and the pressing bar 58 from its retracted position to its pressing position and for subsequently sequentially returning the pressing bar 58 to its retracted position and the movable jaw 53 to its released position.

Specifically, the means mounting the movable jaw 53 on the frame 46 for movement includes two spaced parallel guide rods 63 (only one of which is shown, see FIG. 5) fixed at their ends on the frame 46, which guide rods 63 extend through bearings defining transverse openings in the movable jaw 53 so that the movable jaw 53 is transversely slidably mounted on the guide rods 63 for movement relative to the fixed jaw 52 between its clamped and released positions relative to a stack 22 of cover plates 35 and 39 and/or sheets 18 between the jaws 52 and 53. The horizontal locating wall having the horizontal alignment surface 47, the vertical wall 48 having the vertical alignment surface and a vertical wall spaced from the vertical wall 48 at the opposite end of the horizontal wall are fixed at corresponding edges to and project from the stack engaging surface of the movable jaw 53 toward the fixed jaw 52 and are positioned so that they will respectively pass below and off the ends of the fixed jaw 52 so that the stack engaging surfaces of the fixed and movable jaws 52 and 53 can contact each other, while having sufficient length in a direction normal to those stack engaging surfaces so that very thick stacks 22 (e.g., up to 7.62 centimeters (3 inches) thick) may be supported and aligned thereon.

The clamping means includes, in addition to the jaws 52 and 53, two roller assemblies 65 (only one of which is shown, see FIG. 5) one of which roller assemblies 65 is movable along the bottom edge of each of two side walls 64 of the frame 46 along a path defined by a slot 68 in the sidewall 64 through which an axle for the roller assembly 65 extends and a horizontal guide plate 69 along the bottom edge of the side wall 64 along which spaced rollers on the roller assembly 65 can roll. A pair of coiled negator type constant tension springs 66 are rotatably mounted on spaced downwardly extending projections 67 at the ends of the movable jaw 53 and have spring end portions journaled around the axles of the the roller assemblies 65 so that a constant tension is applied by the springs 66 to bias the movable jaw 53 and the roller assemblies 65 toward each other.

The manually operable actuating means 61 for sequentially moving the movable jaw 53 from its released position to its clamped position and the pressing bar 58 from its retracted position to its pressing position and for subsequently returning the pressing bar 58 to its retracted position and the movable jaw 53 to its released position comprises an operating lever 70 fixed at one end to a shaft 71 (see FIG. 7) that is rotatably mounted on the frame 46, which operating lever 70 has a manually engageable handle 72 at its end opposite the shaft 71. An operating plate (not shown) having the same shape as the operating lever 70 below the dotted line 75 is fixed in direct opposition to the operating lever 70 on the end of the shaft 71 opposite the operating lever 70 and along the outer surface of the opposite sidewall 64. Two links 73 are respectively pivotably attached at first ends by pins 74 to side projecting portions 76 of the operating lever 70 and operating plate, and at opposite ends around the axles of the roller assemblies 65 so that manual movement of the operating lever 70 from an initial position (FIGS. 5, 6, and 7) to a final position (FIGS. 9, 10, and 11) will move the links 73 and thereby the roller assembles 65 and movable jaw 53 from a retracted position with the movable jaw 53 in its released position at which the roller assemblies 65 abut the projections 67 from the movable jaw 53, toward an extended position with the links 73 and projections 76 from the operating lever 70 and operating plate more nearly in axial alignment to move the roller assemblies 65 and thereby the movable jaw 53 toward its clamped position so that the movable jaw 53 will move with the roller assemblies 65 into engagement with any stack 22 of sheets 18 between the fixed and movable jaws 52 and 53 and will thereafter be biased into engagement with that stack 22 of sheets 18 with a predetermined force applied by the constant tension springs 66 of preferably of about 11.3 kilograms (25 pounds) regardless of the thickness of the stack 22 after the roller assemblies 65 are thus separated from the movable jaw 53 in contact with the stack 22 of sheets 18. Movement of the links 73 from their retracted positions to their extended positions causes the centers of the pins 74 to pass through and slightly past positions aligned with the centers of the shaft 71 and rollers 65 so that the tension applied by the springs 66 will hold the links 73 in their extended positions.

The means for mounting the pressing bar 58 on the frame 46 for movement between its retracted position (FIGS. 5, 6, 7, and 8) spaces from the side surface 23 of the stack 22 in its straight position and its pressing position more closely adjacent the planar surface portion 56 so that the pressing bar 58 can move the stack 22 from the straight position to the arched position with one side surface 23 of the stack 22 pressed into contact with the arcuate and planar surface portions 55 and 56 comprises a spaced pair of arms 78 attached at the opposite ends of the pressing bar 58, each of which arms 78 has an opposite end portion 79 (only one of which is shown, see FIGS. 7 and 8) that extends at an angle to a main portion of the arm 78 on which the pressing bar 58 is supported. The end portions 79 are parts of two six bar linkages along the outer surfaces of the side walls 64 (only one of which is shown), which six bar linkages each further include a first bar 80 pivotably mounted on the shaft 71 to which the operating lever 70 and operating plate are fixed. Each first bar 80 has a pin 82 at its end opposite the shaft 71 that extends through an arcuate slot formed in an arcuate projecting portion 83 of either the operating lever 70 or the operating plate. Each six bar linkage also includes a second bar 84 that is pivotably mounted on the frame 46 at a pin 85 and at its end opposite the pin 85 is pivotably mounted by a pin 86 to the adjacent arm 78 at the juncture between its main portion and its end portion 79; a third bar 88 pivotably attached at one end by a pin 89 to the adjacent second bar 84 between the pins 85 and 86 and offset from a line between them, and pivotably attached at its opposite end to the inner end of the pin 82 that extends through the arcuate slot from the adjacent first bar 80; and a fourth bar 91 that is pivotably mounted on the frame 46 at a pin 92 and is pivotably mounted by a pin 90 at its end opposite the pin 92 to the end of the adjacent arm 78. The locations and distances between the shaft 71 and pins 82, 85, 86, 89, 90 and 92 have been selected to cause the pressing bar 58 to move in an non circular arcuate path from its retracted to its pressing position, which arcuate path has been selected so that the pressing bar 58 when moved to its pressing position will always engage the side surfaces 23 of stacks 22 of sheets 18 of different thickness adjacent the spine edge 19 of their uppermost sheet 18, which contact location is desirable to properly press the sheets 18 against the planar surface portion 56 for engagement by the pressure sensitive adhesive layer, but would not be achieved if the pressing bar 58 moved in a radius about a pivot point fixed on the frame 46 since the spine edges 19 of the uppermost sheets 18 in stacks 22 of sheets 18 will be located closer to the arcuate surface portion 55 along the planar surface portion 56 as the thicknesses of the stacks 22 of sheets 18 increases.

Figure 7:
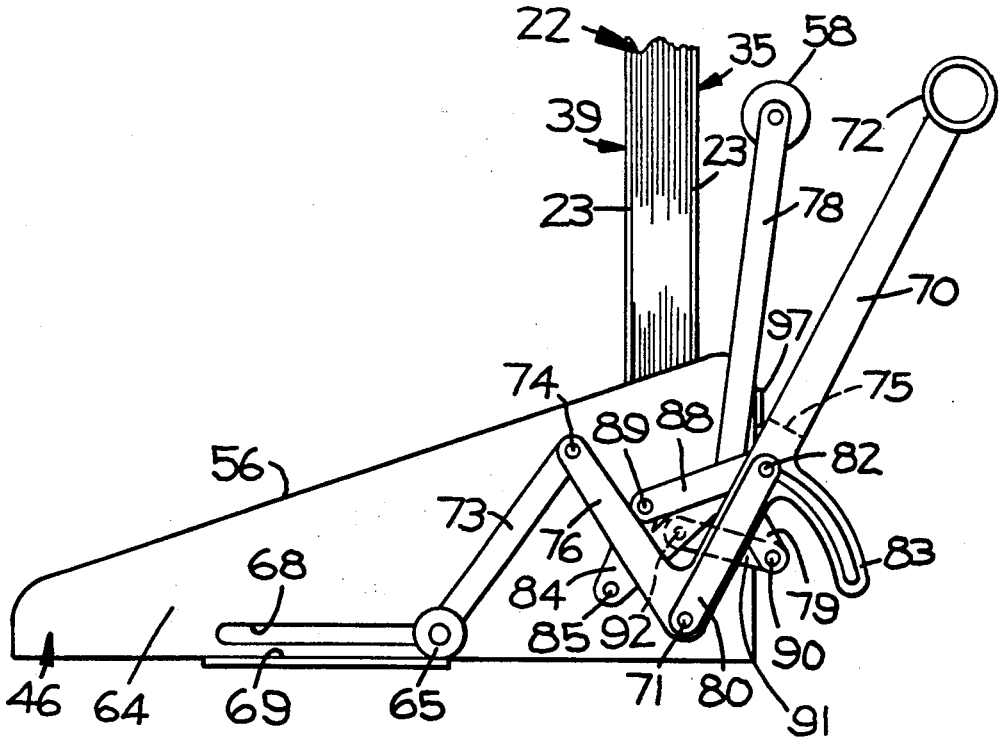
Figure 8:
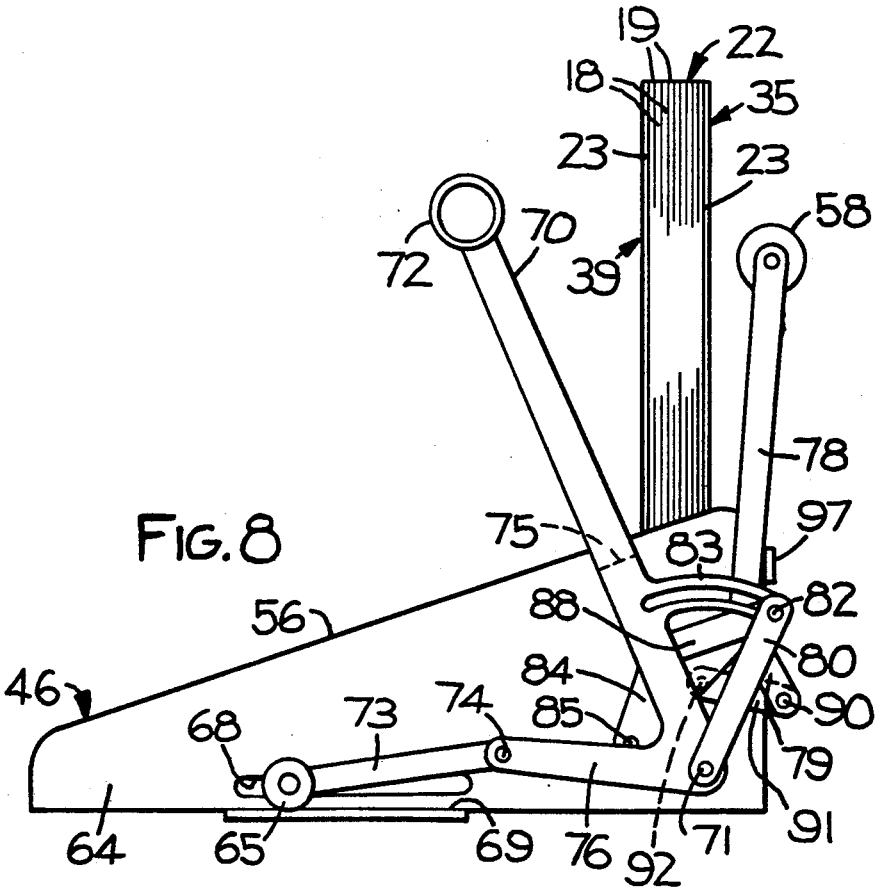
Figure 10:
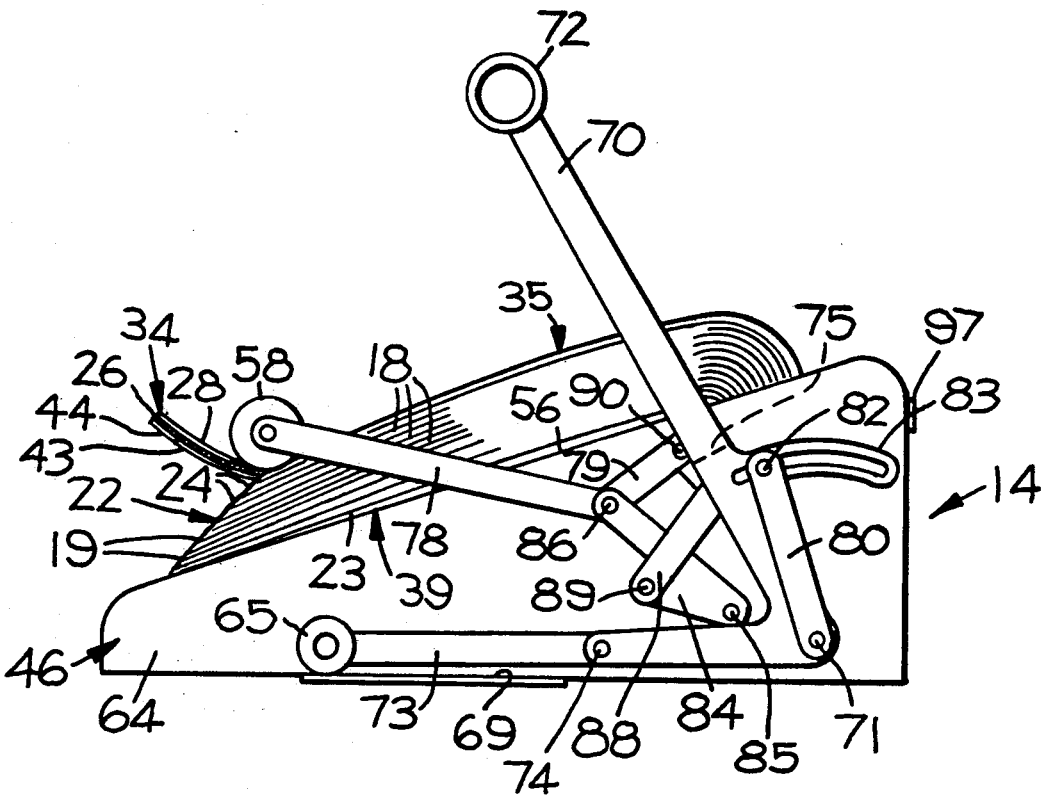

The locations of the pins 82, 85, 86, 89, 90 and 92 and shaft 71 of the six bar linkages (which locations are illustrated to scale in FIGS. 7, 8, and 10, and when the distance between the shaft 71 and the pin 82 is 7.62 centimeter (3 inch) are suitable for stacks of sheets 21.59 centimeter (8.5 inch) long between their spine edges 19 and outer edges 20) provide an effective pivot point for the pressing bar 58 such that in the retracted position of the pressing bar 58, the weight of the pressing bar 58 will bias it away from its pressing position, however, when the pressing bar 58 is moved only a short distance toward its pressing position from its retracted position past a center position, its weight will bias it toward its pressing position with the arms 78 against stop lugs 97 on the frame 46. The slot in the curved projecting portion 83 of the operating lever 70 has a length such that engagement of the distal end of the curved projecting portion 83 with the pin 82 extending through the slot as the operating lever 70 is moved a short last portion of the distance from its initial position to its final position will pull the pin 82 and thereby the pressing bar 58 from its retracted position past its center position, whereupon its weight (which may be supplemented by springs between the frame 46 and the arms 78, not shown) will move the pressing bar 58 to its pressing position causing the pin 82 to move along the slot in the curved projecting portion 83, which movement may be slowed by a pair of dash pots (not shown) attached between the frame 46 and the arms 78. At the pressing position the pressing bar 58 and any springs between the frame 46 and the arms 78 should provide a force of about 1 kilogram (2.25 pounds) against the side surface 23 of a stack 22 of sheets 18 in the device 14. Subsequently, when the operating lever 70 is moved back to its initial position from its final position, the proximal end of the curved projecting portion 83 will engage and move the pin 82 extending through the slot, and thereby the pressing bar 58 back toward its retracted position and past its center position so that its weight returns it to its retracted position.

Operation

The use of the device 14 and subsequent manual steps to bind sheets 18 using the cover structure 12 is sequentially illustrated in FIGS. 6 through 15.

Figure 6:
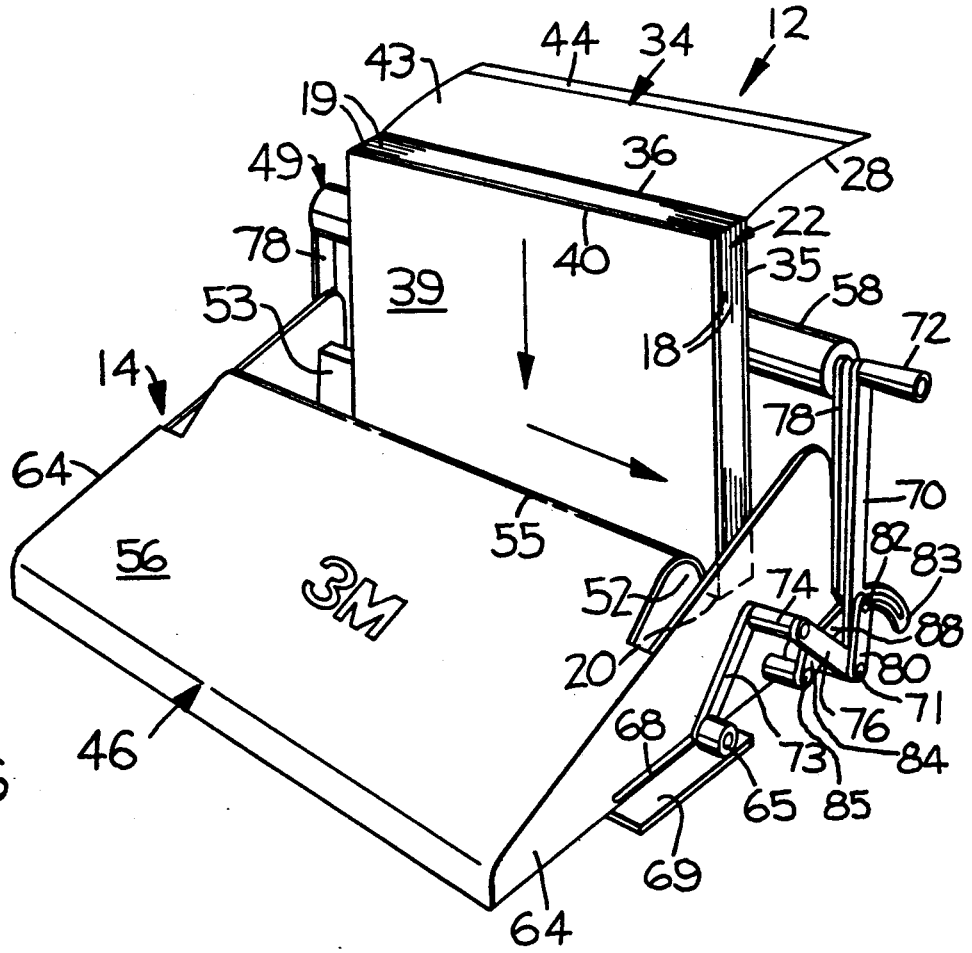
FIGS. 6 through 15 are perspective or side views illustrating sequential steps for binding connected fan folded sheets using the cover structure of FIG. 4 and the device of FIG. 5.

The device 14 is initially adjusted so that the movable jaw 53 of the clamping means is in its released position and the pressing bar 58 is in its retracted position and the stack 22 of sheets 18 to be bound and the cover plates 35 and 39 of the cover structure 12 are positioned between the jaws 52 and 53 with their outer edges 20 supported on the horizontal surface 47 (see FIG. 5) and their side edges aligned against the vertical wall 48 as shown by the arrows in FIG. 6, with the first cover plate 35 adjacent the pressing bar 58 with its inner surface 37 against one side surface 23 of the stack 22, and the second cover plate 39 positioned with its inner surface along the other side surface 23 of the stack 22. The sheets 18 and cover plates 35 and 39 are then jogged to position their sides against the vertical wall 48 and insure that they are all down as far as possible against the horizontal surface 47, and the operating lever 70 is then moved from its initial position (FIGS. 5, 6 and 7) to its final position, at which final position the operating lever 70 will remain without holding it, (FIGS. 9, 10 and 11) to sequentially move the movable jaw 53 from its released position to its clamped position and the pressing bar 58 from its retracted position to its pressing position so that a portion of the stack 22 of sheets 18 between their spine and outer edges 19 and 20 is arched against the arcuate and planar surface portions 55 and 56 while the jaws 52 and 53 retain the outer edges 20 of the sheets 18 in a plane at a right angle to adjacent portions of the side surfaces 23 to cause relative slippage of portions of the sheets 18 adjacent their spine edges 19 under the pressing bar 58 and expose narrow side surface portions 24 of corresponding sides of the sheets 18 adjacent their spine edges 19 as can be seen in FIGS. 10 and 11.

Figure 11:
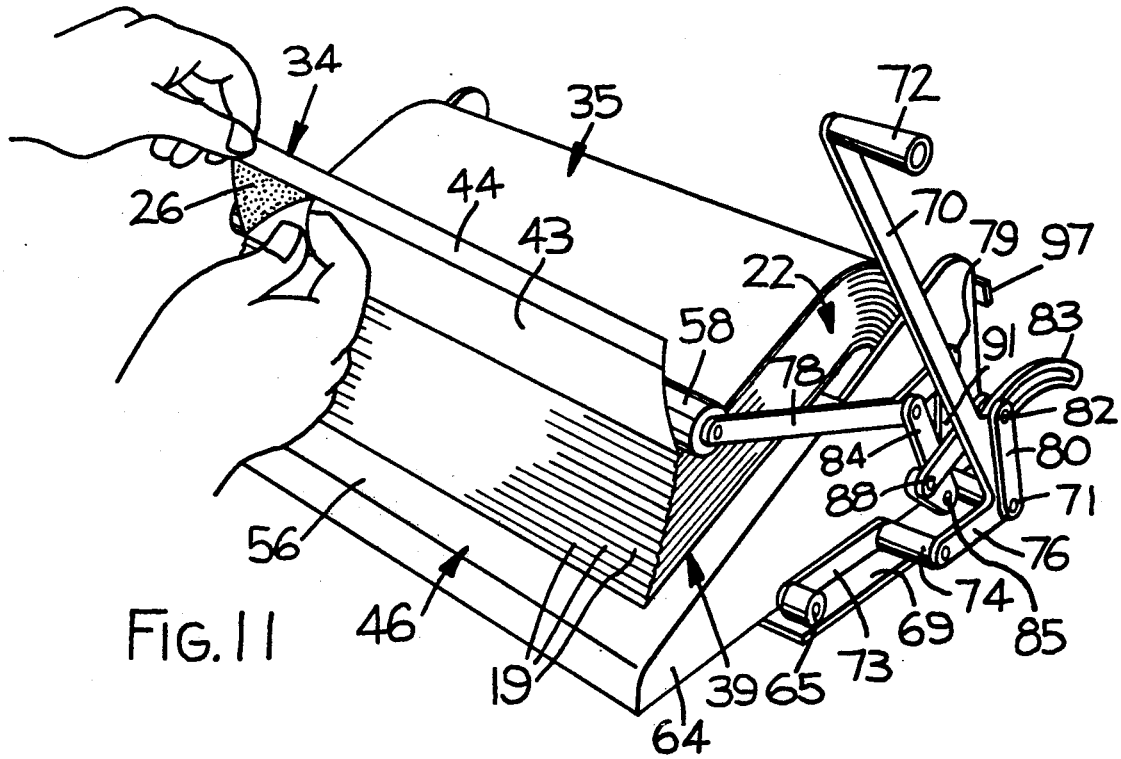

The first release liner 43 is then manually removed from the layer 26 of pressure sensitive adhesive as is illustrated in FIG. 11, the second release liner 44 and opposite portions of the backing 28 are grasped to pull the layer 26 of pressure sensitive adhesive on the hacking 28 into smooth engagement with the narrow side surface portions 24 and spine edges 19 of the sheets 18 (not shown) and adhere any portion of the layer 26 of pressure sensitive adjacent the second release liner 44 that extends past the stack 22 of sheets 18 against the surface portion 56 which has a release surface (e.g., silicone), whereupon that engagement with the sheets 18 is completed through the manual use of the flexible pressing blade 95 as is illustrated in FIG. 12.

The operating lever 70 is then manually moved back to its initial position to return the pressing bar 58 to its retracted position from its pressing position and return the movable jaw 53 to its released position from its clamped position as shown in FIG. 13 so that the arched stack 22 of sheets 18 can be removed from the device 14 as shown in FIG. 13 and have its sheets 18 manually straightened to again cause relative slippage of portions of the sheets 18 adjacent their spine edges 19 to again align their spine edges 19 in a plane generally at a right angle to the side surfaces 23 of the stack 22 as is illustrated in FIG. 14 and cause the layer of pressure sensitive adhesive 26 and backing 28 to pleat by retained adhesion of the layer 26 of pressure sensitive adhesive with the spine edges 19 and the narrow side surface portions 24 of the sheets 18 initially contacted by the layer 26 of pressure sensitive adhesive, and cause adhesion of the layer 26 of pressure sensitive adhesive to narrow side surface portions 30 of the sheets 18 adjacent the narrow side surface portions 24 of the sheets 18 initially contacted by the layer 26 of pressure sensitive adhesive.

The second cover plate 39 is then moved to a position at a right angle with respect to the stack 22, and the inner surface 42 of the second cover plate 39 along its spine edge 40 is pressed against the end portion 32 of the flexible backing 28 while it is supported on a planar surface to adhere the portion of the layer 26 of pressure sensitive adhesive previously adhered to the surface portion 56 against the outer surface of the second cover plate 39 as is shown in FIG. 14. The second release liner 44 is then removed from the layer 26 of pressure sensitive adhesive as shown in FIG. 15, and the remaining unadhered part of the end portion 32 is manually adhered by the layer 26 of pressure sensitive adhesive to the second cover plate 39 adjacent its spine edge. The binding of the document 16 is then completed.

The system according to the present invention has now been described. It will be apparent to those skilled in the art that many changes can be made in the system and portions thereof described without departing from the scope of the present invention. Thus the scope of the present invention should not be limited to the methods and structures described in this application, but only by methods or structures described by the language of the claims and the equivalents of those methods and structures.

We claim:

1. A bound document comprising:

a multiplicity of similarly sized sheets each having a spine edge, an outer edge opposite said spine edge, and opposite major side surfaces, said sheets being disposed in a stack having opposite sides with the spine edges of said sheets aligned to define a generally planar surface at generally a right angle to said opposite sides, each of said sheets, except for the outermost sheets in the stack which are each joined only along one of said edges, being joined at both of said edges to sheets adjacent its major side surfaces with the spine edges of the sheet being joined to the spine edge of the sheet along one of said side surfaces, and the outer edge of the sheet being joined to the outer edge of the sheet along the other of said side surfaces;

a pair of cover plates disposed on opposite sides of said stack and each having a spine edge aligned with the spine edges of the sheets in said stack;

a highly flexible strong backing having low resilience; and a layer of pressure sensitive adhesive adhered to said backing, which layer of pressure sensitive adhesive has been adhered across the aligned spine edges of said sheets and cover plates and along narrow side surface portions adjacent said spine edges on corresponding sides of said sheets when said sheets were disposed to expose said narrow side surface portions relative to said adjacent sheets;

said layer of pressure sensitive adhesive and said backing being pleated by retained adhesion of said layer of pressure sensitive adhesive to said spine edges and said narrow side surface portions contacted by the layer of pressure sensitive adhesive when said sheets were disposed to expose said narrow side surface portions relative to said adjacent sheets;

said layer of pressure sensitive adhesive adhering to narrow side surface portions of the sheets adjacent the narrow side surface portions of the sheets contacted by the layer of pressure sensitive adhesive when said sheets were disposed to expose said narrow side surface portions relative to said adjacent sheets;

said backing having end portions adhered to portions of said cover plates adjacent said spine edges;

said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test sample of sheet material is pressed adjusted to be 0.635 centimeter wide and said test sample of sheet material is caused by the test to bend in an arc extending in the same direction along the test sample of material as the arcs around which the sheet material will have to bend to form pleats; and said pressure sensitive adhesive having a minimum adhesion of 30 ounces per inch, when tested in accordance with ASTM D 3330-81 by adhering a piece of white bond paper to a glass plate with double coated tape, adhering a ½ inch wide strip comprising the pressure sensitive adhesive to be tested on a backing to the surface of the paper opposite the glass plate, and peeling one end of the strip from the paper by bending the strip 180 degrees and pulling it parallel to the surface of the paper so that the adhesive is pealed from the paper at a speed of 12 inches per minute; resists dead load peel for at least 500 minutes when tested by adhering a piece of the same white bond paper to a stainless steel plate with double coated tape, adhering a ½ inch wide strip comprising a layer of the pressure sensitive adhesive to be tested on a backing to the surface of the piece of paper opposite the stainless steel plate along a ¾ inch length at one end of the strip, positioning the plate vertically, bending the strip 180 degrees away from the plate, and hanging a 100 gram weight from the end of the strip opposite its adhered end length so that the weight tends to peel the strip from the piece of paper; and achieves a value of at least 15 ounces per inch when tested by the test identified as Quick Stick PSTL-5, which is Test number 5 of Pressure Sensitive Tape Counsel.

2. A bound document according to claim 1, wherein said backing is a nonwoven fabric having a flexibility/stiffness in the range of about 50 to 110 grams resistance to flexing when measured in accordance with the International Nonwoven Disposable Association Handle-O-Meter Stiffness Standard Test, IST 90.0-75 R-82 using a test sample of said nonwoven fabric 20.32 centimeter by 20.32 centimeter and having a slot into which said test sample of nonwoven fabric is pressed adjusted to be 0.635 centimeter wide and said test sample of nonwoven fabric is caused by the test to bend in an arc extending in the same direction along the test sample of fabric as the arcs around which the nonwoven fabric will have to bend to form pleats.

3. A bound document according to claim 1, wherein said backing is a polymeric film having a flexibility/stiffness in the range of about 12 to 125 grams resistance to flexing when measured in accordance with the International Nonwoven Disposable Association Handle-O-Meter Stiffness Standard Test, IST 90.0-75 R-82 using a test sample of said film 20.32 centimeter by 20.32 centimeter and having a slot into which said test sample of film is pressed adjusted to be 0.635 centimeter wide and said test sample of film is caused by the test to bend in an arc extending in the same direction along the test sample of film as the arcs around which the film will have to bend to form pleats.

4. A bound document comprising:

a multiplicity of similarly sized sheets each having a spine edge, an outer edge opposite said spine edge, and opposite major side surfaces, said sheets being disposed in a stack having opposite sides with the spine edges of said sheets aligned to define a generally planar surface at generally a right angle to said opposite sides, each of said sheets, except for the outermost sheets in the stack which are each joined along only one of said edges, being joined at both of said edges to sheets adjacent its major side surfaces with the spine edges of the sheet being joined to the spine edge of the sheet along one of said side surfaces, and the outer edge of the sheet being joined to the outer edge of the sheet along the other of said side surfaces;

a highly flexible strong backing having low resilience; and a layer of pressure sensitive adhesive adhered to said backing, which layer of pressure sensitive adhesive has been adhered across the aligned spine edges of said sheets and along narrow side surface portions adjacent said spine edges on corresponding sides of said sheets when said sheets were disposed to expose said narrow side surface portions relative to said adjacent sheets;

said layer of pressure sensitive adhesive and said flexible backing being pleated by retained adhesion of said layer of pressure sensitive adhesive to said spine edges and said narrow side surface portions contacted by the layer of pressure sensitive adhesive when said sheets were disposed to expose said narrow side surface portions relative to said adjacent sheets;

said layer of pressure sensitive adhesive adhering to narrow side surface portions of the sheets adjacent the narrow side surface portions of the sheets contacted by the layer of pressure sensitive adhesive when said sheets were disposed to expose said narrow side surface portions relative to said adjacent sheets;

said backing having end portions adhered to portions of the end sheets in said stack adjacent said spine edges;

said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test sample of sheet material is pressed adjusted to be 0.635 centimeter wide and said test sample of sheet material is caused by the test to bend in an arc extending in the same direction along the test sample of material as the arcs around which the sheet material will have to bend to form pleats; and said pressure sensitive adhesive having a minimum adhesion of 30 ounces per inch, when tested in accordance with ASTM D 3330-81 by adhering a piece of white bond paper to a glass plate with double coated tape, adhering a ½ inch wide strip comprising the pressure sensitive adhesive to be tested on a backing to the surface of the paper opposite the glass plate, and peeling one end of the strip from the paper by bending the strip 180 degrees and pulling it parallel to the surface of the paper so that the adhesive is pealed from the paper at a speed of 12 inches per minute; resists dead load peel for at least 500 minutes when tested by adhering a piece of the same white bond paper to a stainless steel plate with double coated tape, adhering a ½ inch wide strip comprising a layer of the pressure sensitive adhesive to be tested on a backing to the surface of the piece of paper opposite the stainless steel plate along a ¾ inch length at one end of the strip, positioning the plate vertically, bending the strip 180 degrees away from the plate, and hanging a 100 gram weight from the end of the strip opposite its adhered end length so that the weight tends to peel the strip from the piece of paper; and achieves a value of at least 15 ounces per inch when tested by the test identified as Quick Stick PSTL-5, which is Test number 5 of Pressure Sensitive Tape Counsel.

5. A bound document according to claim 4, wherein said backing is a nonwoven fabric having a flexibility/stiffness in the range of about 50 to 110 grams resistance to flexing when measured in accordance with the International Nonwoven Disposable Association Handle-O-Meter Stiffness Standard Test, IST 90.0-75 R-82 using a test sample of said nonwoven fabric 20.32 centimeter by 20.32 centimeter and having a slot into which said test sample of nonwoven fabric is pressed adjusted to be 0.635 centimeter wide and said test sample of nonwoven fabric is caused by the test to bend in an arc extending in the same direction along the test sample of fabric as the arcs around which the nonwoven fabric will have to bend to form pleats.

6. A bound document according to claim 4, wherein said backing is a polymeric film having a flexibility/stiffness in the range of about 12 to 125 grams resistance to flexing when measured in accordance with the International Nonwoven Disposable Association Handle-O-Meter Stiffness Standard Test, IST 90.0-75 R-82 using a test sample of said film 20.32 centimeter by 20.32 centimeter and having a slot into which said test sample of film is pressed adjusted to be 0.635 centimeter wide and said test sample of film is caused by the test to bend in an arc extending in the same direction along the test sample of film as the arcs around which the film will have to bend to form pleats.

7. A cover structure adapted for use to bind a multiplicity of similarly sized sheets in a stack having opposite side surfaces, each of which sheets has a spine edge, an outer edge opposite said spine edge, and opposite major side surfaces, and each of which sheets, except for the outermost sheets in the stack which are joined at only one of said edges, is joined at both of said edges to sheets adjacent its major side surfaces in the stack with the spine edges of the sheet being joined to the spine edge of the sheet along one of said side surfaces, and the outer edge of the sheet being joined to the outer edge of the sheet along the other of said side surfaces, said cover structure comprising:

a first cover assembly including a first cover plate having a spine edge, an inner surface adapted to be placed adjacent one side of said stack, and an outer surface, a strong highly flexible backing having low resilience adhered to a portion of the outer surface of said first cover plate adjacent the spine edge of said first cover plate and projecting past said spine edge, and a layer of pressure sensitive adhesive adhered to the projecting portion of said backing; and a second cover plate having a spine edge and an inner surface adapted to be placed adjacent a side of the stack opposite said first cover plate with said spine edge of said first cover plate aligned with the spine edges of the stack, so that with said cover plates positioned on opposite sides of the stack and the stack disposed with narrow side surface portions along the spine edges of the sheets exposed, said layer of pressure sensitive adhesive can be applied to the spine edges and adjacent narrow side surface portions of the sheets and to a portion of said second cover plate adjacent said spine edge, and the sheets in the stack moved relative to each other to a position with the spine edges of the sheets in the stack positioned at a right angle with respect to the side surfaces of the stack;

said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test sample of sheet material is pressed adjusted to be 0.635 centimeter wide and said test sample of sheet material is caused by the test to bend in an arc extending in the same direction along the test sample of material as the arcs around which the sheet material will have to bend to form pleats; and said pressure sensitive adhesive having a minimum adhesion of 30 ounces per inch, when tested in accordance with ASTM D 3330-81 by adhering a piece of white bond paper to a glass plate with double coated tape, adhering a ½ inch wide strip comprising the pressure sensitive adhesive to be tested on a backing to the surface of the paper opposite the glass plate, and peeling one end of the strip from the paper by bending the strip 180 degrees and pulling it parallel to the surface of the paper so that the adhesive is pealed from the paper at a speed of 12 inches per minute; resists dead load peel for at least 500 minutes when tested by adhering a piece of the same white bond paper to a stainless steel plate with double coated tape, adhering a ½ inch wide strip comprising a layer of the pressure sensitive adhesive to be tested on a backing to the surface of the piece of paper opposite the stainless steel plate along a ¾ inch length at one end of the strip, positioning the plate vertically, bending the strip 180 degrees away from the plate, and hanging a 100 gram weight from the end of the strip opposite its adhered end length so that the weight tends to peel the strip from the piece of paper; and achieves a value of at least 15 ounces per inch when tested by the test identified as Quick Stick PSTL-5, which is Test number 5 of Pressure Sensitive Tape Counsel;

so that said backing and layer of pressure sensitive adhesive are sufficiently flexible and low in resilience to pleat while remaining adhered together by retained adhesion of said layer of pressure sensitive adhesive to the spine edges and adjacent narrow edge portions of the sheets during such application.

8. A cover structure according to claim 7 further including a first release liner over a major portion of the layer of pressure sensitive adhesive adhered to said backing adjacent said first plate, and a second release liner over a minor portion of the layer of pressure sensitive adhesive adhered to said backing at the end of said backing opposite said first plate.

9. A cover structure according to claim 7, wherein said backing is a nonwoven fabric having a flexibility/stiffness in the range of about 50 to 110 grams resistance to flexing when measured in accordance with the International Nonwoven Disposable Association Handle-O-Meter Stiffness Standard Test, IST 90.0-75 R-82 using a test sample of said nonwoven fabric 20.32 centimeter by 20.32 centimeter and having a slot into which said test sample of nonwoven fabric is pressed adjusted to be 0.635 centimeter wide and said test sample of nonwoven fabric is caused by the test to bend in an arc extending in the same direction along the test sample of fabric as the arcs around which the nonwoven fabric will have to bend to form pleats.

10. A cover structure according to claim 7, wherein said backing is a polymeric film having a flexibility/stiffness in the range of about 12 to 125 grams resistance to flexing when measured in accordance with the International Nonwoven Disposable Association Handle-O-Meter Stiffness Standard Test, IST 90.0-75 R-82 using a test sample of said film 20.32 centimeter by 20.32 centimeter and having a slot into which said test sample of film is pressed adjusted to be 0.635 centimeter wide and said test sample of film is caused by the test to bend in an arc extending in the same direction along the test sample of film as the arcs around which the film will have to bend to form pleats.

11. A binding structure adapted for use to bind a multiplicity of similarly sized sheets in a stack having opposite side surfaces, each of which sheets has a spine edge, an outer edge opposite said spine edge, and opposite major side surfaces, and each of which sheets, except for the outermost sheets in the stack which are joined at only one of said edges, is joined at both of said edges to sheets adjacent its major side surfaces in the stack with the spine edges of the sheet being joined to the spine edge of the sheet along one of said side surfaces, and the outer edge of the sheet being joined to the outer edge of the sheet along the other of said side surfaces, said binding structure comprising:

strong backing that is highly flexible and low in resilience when bent in an arc along a first direction; and a layer of pressure sensitive adhesive adhered to one surface of said backing;

so that with the stack disposed with narrow side surface portions along the spine edges of the sheets exposed, said layer of pressure sensitive adhesive can be applied to the spine edges and adjacent narrow side surface portions of the sheets, and the sheets in the stack moved relative to each other to a position with the spine edges of the sheets in the stack positioned at a right angle with respect to the side surfaces of the stack;

said backing being a sheet material having a flexibility/stiffness of less than about 200 grams resistance to flexing when measured in accordance with the International Nonwoven Disposable Association Handle-O-Meter Stiffness Standard Test, IST 90.0-75 R-82, using a test sample of said sheet material 20.32 centimeter by 20.32 centimeter and having a slot into which said test sample of sheet material is pressed adjusted to be 0.635 centimeter wide and said test sample of sheet material is caused by the test to bend in an arc extending in the same direction along the test sample of material as the arcs around which the sheet material will have to bend to form pleats; and said pressure sensitive adhesive having a minimum adhesion of 30 ounces per inch, when tested in accordance with ASTM D 3330-81 by adhering a piece of white bond paper to a glass plate with double coated tape, adhering a ½ inch wide strip comprising the pressure sensitive adhesive to be tested on a backing to the surface of the paper opposite the glass plate, and peeling one end of the strip from the paper by bending the strip 180 degrees and pulling it parallel to the surface of the paper so that the adhesive is pealed from the paper at a speed of 12 inches per minute; resists dead load peel for at least 500 minutes when tested by adhering a piece of the same white bond paper to a stainless steel plate with double coated tape, adhering a ½ inch wide strip comprising a layer of the pressure sensitive adhesive to be tested on a backing to the surface of the piece of paper opposite the stainless steel plate along a ¾ inch length at one end of the strip, positioning the plate vertically, bending the strip 180 degrees away from the plate, and hanging a 100 gram weight from the end of the strip opposite its adhered end length so that the weight tends to peel the strip from the piece of paper; and achieves a value of at least 15 ounces per inch when tested by the test identified as Quick Stick PSTL-5, which is Test number 5 of Pressure Sensitive Tape Counsel;

so that said backing and layer of pressure sensitive adhesive being sufficiently flexible and low in resilience to pleat while remaining adhered together by retained adhesion of said layer of pressure sensitive adhesive to the spine edges and adjacent narrow edge portions of the sheets during such application.

12. A binding structure according to claim 11, wherein said backing is a nonwoven fabric having a flexibility/stiffness in the range of about 50 to 110 grams resistance to flexing when measured in accordance with the International Nonwoven Disposable Association Handle-O-Meter Stiffness Standard Test, IST 90.0-75 R-82 using a test sample of said nonwoven fabric 20.32 centimeter by 20.32 centimeter and having a slot into which said test sample of nonwoven fabric is pressed adjusted to be 0.635 centimeter wide and said test sample of nonwoven fabric is caused by the test to bend in an arc extending in the same direction along the test sample of fabric as the arcs around which the nonwoven fabric will have to bend to form pleats.

13. A binding structure according to claim 11, wherein said backing is a polymeric film having a flexibility/stiffness in the range of about 12 to 125 grams resistance to flexing when measured in accordance with the International Nonwoven Disposable Association Handle-O-Meter Stiffness Standard Test, IST 90.0-75 R-82 using a test sample of said film 20.32 centimeter by 20.32 centimeter and having a slot into which said test sample of film is pressed adjusted to be 0.635 centimeter wide and said test sample of film is caused by the test to bend in an arc extending in the same direction along the test sample of film as the arcs around which the film will have to bend to form pleats.

14. A device for use in binding a multiplicity of sheets each being of generally the same size, having a spine edge, an outer edge opposite said spine edge, and opposite major side surfaces, said device comprising:

a frame;

positioning means on said frame for positioning the sheets face to face in an aligned stack in a straight position with the spine edges and the outer edges of the sheets aligned in generally horizontal planes at right angles to the side surfaces of the sheets and the side surfaces of the sheets extending generally vertically upwardly from the outer edges of the sheets, said positioning means including a locating wall having a generally horizontal alignment surface adapted to support the outer edges of the sheets; and arching means on said frame and activatable with the stack of sheets initially in said straight position for arching a portion of the stack of sheets between the spine and outer edges of the sheets about an axis parallel to the edges of the sheets while retaining the outer edges of the sheets in a plane at a right angle to adjacent portions of the side surfaces of the sheets to cause relative slippage of portions of the sheets adjacent the spine edges and exposed narrow side surface portions of the sheets adjacent their spine edges on corresponding side surfaces of the sheets so that a layer of pressure sensitive adhesive may be applied thereto, and for subsequently affording return of the arched stack of sheets to said straight position to again cause relative slippage of portions of the the sheets adjacent their spine edges to again align their spine edges in a plane generally at a right angle to the side surface of the sheets, said arching means comprising:

clamping means mounted on said frame adjacent said locating wall and including fixed and movable opposed jaws for firmly clamping the aligned stack of sheets together adjacent their outer edges, said fixed jaw being fixed to said frame, and said clamping means includes means mounting said movable jaw for movement relative to said fixed jaw between clamped and released positions relative to the stack of sheets between said jaws;

means including an arcuate surface portion fixed on said frame at one side of said positioning means for supporting and shaping one side of the stack of sheets clamped by said clamping means into an arc when the end portion of the stack adjacent their spine edges is moved into engagement with said arcuate surface portion;

a pressing bar having opposite ends and an elongate pressure surface between said ends;

means comprising a pair of six bar linkages each including portions of said frame and said pressing bar mounting said pressing bar on said frame for movement relative to said frame between a retracted position along the side of the stack of sheets in its straight position opposite the arcuate surface portion, and a pressing position more closely adjacent said means for supporting so that movement of said pressing bar form said retracted position to said pressing position will press said stack from the straight position to an arched position with the stack in an arc and one side surface of the stack in contact with said arcuate surface portion, said six bar linkages causing movement of said pressing bar along a non circular arcuate path between said retracted position and said pressing position to cause in the pressing position of the pressing bar engagement of said pressing bar with the side surface of the adjacent sheet in the stack adjacent the spine edge of that adjacent sheet for stacks of sheets of different thicknesses; and means manually operable by manipulation of a single lever for sequentially moving the movable jaw of the clamp from its released position to its clamped portion and the pressing bar from its retracted position to its pressing position, and then sequentially returning the pressing bar from its pressing to its retracted position and the movable jaw from its clamped to its released position.

15. A device according to claim 14 wherein said means for clamping includes means for applying a uniform predetermined force of about 11.34 kilograms to stacks of sheets of different thicknesses between said jaws.

16. A device according to claim 14 wherein said means for mounting said pressing bar includes means for causing in the pressing position of the pressing bar engagement of said pressing bar with the side surface of the adjacent sheet in the stack with a force of about 1 kilogram.

17. A device according to claim 14 wherein said means for supporting further includes a planar surface portion adjacent said arcuate surface portion; said planar surface portion having a release surface adapted to be releasably adhered to by the layer of pressure sensitive adhesive.

* * * * *